United States Patent [19]

Ori et al.

[11] Patent Number: 4,475,667

[45] Date of Patent: Oct. 9, 1984

[54] AEROSOL ASSEMBLY FOR SIGNALLING DEPLETION OF A PRESELECTED AMOUNT OF THE CONTAINER CONTENTS WHEN IN AN INVERTED POSITION

[75] Inventors: Peter Ori, Barrington; Carleen Kreider, Buffalo Grove, both of Ill.

[73] Assignee: Seaquist Valve Company, Cary, Ill.

[21] Appl. No.: 455,986

[22] Filed: Jan. 6, 1983

[51] Int. Cl.[3] ..... B67D 5/32; B65D 83/06

[52] U.S. Cl. ..... 222/39; 222/402.19; 222/464; 239/342

[58] Field of Search ..... 222/39, 64, 211, 376, 222/382, 394, 402.1, 402.16–402.19, 464, 564; 239/71, 337, 342

[56] References Cited

U.S. PATENT DOCUMENTS

| | | | |
|---|---|---|---|
| 2,924,360 | 2/1960 | Samuel | 222/376 X |
| 3,601,317 | 8/1971 | Genantonio | 222/211 X |
| 3,647,119 | 3/1972 | Samuelson | 222/402.18 |
| 3,893,596 | 7/1975 | Beres et al. | 222/402.19 |
| 4,211,347 | 7/1980 | Mildern | 222/402.18 |

*Primary Examiner*—Joseph J. Rolla
*Assistant Examiner*—Michael S. Huppert
*Attorney, Agent, or Firm*—Dressler, Goldsmith, Shore, Sutker & Milnamow

[57] ABSTRACT

Disclosed herein is an aerosol assembly which may be used inverted and upright and which, when used in the inverted position, will automatically provide an audible signal that a preselected amount of the container contents has been depleted. A valve body defining a hollow interior and a base has a hollow diptube operatively connected to the valve body interior and reaching at its lower end to the bottom of an associated aerosol container. A moveable valve stem is provided for placing the valve body interior in communication with the exterior of the aerosol container. A liquid level spray control is provided. The control comprises a hollow tube connected to the valve body and surrounding the diptube. The hollow tube defines an opening below the valve body base. The opening defines an open flow path from the container interior to the valve body interior. The hollow tube extends downwardly from the valve body base and is positioned no closer to the valve body base than 20% of the distance between the base and the diptube lower end and no closer to the diptube lower end than 80% of the distance between the base and the diptube lower end. The opening is in open flow communication with the valve body interior when the aerosol container and associated valve assembly are in each of their inverted and upright positions.

10 Claims, 7 Drawing Figures

AEROSOL ASSEMBLY FOR SIGNALLING DEPLETION OF A PRESELECTED AMOUNT OF THE CONTAINER CONTENTS WHEN IN AN INVERTED POSITION

FIELD OF THE INVENTION

This invention relates to an improved aerosol assembly which may be used inverted and upright and which, when used in the inverted position, will automatically provide an audible signal that a preselected amount of the container contents has been depleted.

BACKGROUND OF THE INVENTION

Various types of aerosol packages are presently available. Some are intended for continuous spraying or fogging. Some are provided primarily for upright use. Still others are intended both for upright and inverted use. The nature of the valving supplied with a particular aerosol package depends upon the principle purpose or purposes for which the contents are to be used and the orientation of the container in which the user is likely to use it.

One increasingly important use for aerosols is in the control and eradication of insects, such as fleas. When rooms in homes are to be sprayed for fleas, the preferred practice is to provide a concentrated spray in corners, along edges of the floor, in cabinets and on affected carpet areas. This, of course, requires a spray valve which will discharge intermittent conventional streams or bursts with the container preferably in an inverted position. The treatment of affected areas additionally preferably requires fogging, i.e., the continuous discharge of a substantial portion of a container into an enclosed area, such as in a closed room. Of course, the user should not remain in the area as that is done. Accordingly, special available continuous spray actuator assemblies are available for this purpose.

It is very important that certain minimum amounts of materials to be dispensed from an aerosol container should be dispensed in the continuous mode.

At present, although valving assemblies are available for each of these purposes, there is none readily available which will enable a user to be certain that the minimum amount necessary for effective fogging of a given room area (as pursuant to EPA requirements) will be available after some of the contents have been used for spot or intermittent spraying. To be absolutely certain that a preselected amount will be available, the user must purchase and use two separate containers. Also, because there is no way in which a user can be certain the minimum amount for fogging will be available, labelling requirements restrict the freedom of aerosol insecticide packagers to promote and advertise the efficacy of a single package for combined intermittent and continuous use.

It is with an improved aerosol assembly and package that will automatically provide a positive and readily perceived signal that the remaining portion of the container contents should be discharged in the continuous, fogging mode with which the invention of this application is concerned. As will appear, the invention includes the use of a diptube and an auxiliary hollow tube. In concept and operation it is very different from aerosol assemblies which have double dip tube arrangements, as for example in U.S. Pat. Nos. 4,141,472 and 3,647,119.

SUMMARY OF THE INVENTIOR

The present invention provides an improved aerosol container and valve assembly which is inexpensive and adapted to signal automatically, when used in an inverted position, that the remaining contents of the container should be discharged in the upright, continuous, fogging mode. The aerosol container itself may be conventional. The valve assembly comprises, in addition to conventional gaskets, actuators and the like generally known to be the minimum elements necessary to effect aerosol discharge in an upright manner, a valve body defining a hollow interior and a base, a hollow diptube operatively connected to the valve body interior and adapted to reach, at its lower end, to the bottom of the aerosol container, and a moveable valve stem for placing the valve body interior in communication with the ambient atmosphere.

In accordance with the improved automatically signalling aerosol valve assembly of the present invention, there is provided a liquid level spray control means comprising a hollow tube surrounding the diptube and defining a control opening means positioned between the valve body base and the diptube lower end. The control opening is positioned no closer to the valve body base than 20% of the distance between the base and the diptube lower end and desirably is in the midregion therebetween. The control opening means is in open flow communication with the valve body interior when the aerosol container and associated valve assembly are in both an inverted position and an upright position, through an opening defined by the valve body.

In the preferred construction, the hollow tube extends downwardly to the position defined and the control opening means comprises an open lower end of the hollow tube. The control means may further comprise valve means for automatically sealing the diptube from communication with the valve body interior when the aerosol container and valve assembly are in an inverted position. The valve means may comprise a valve seat and a ball valve in the diptube which is seated on the valve seat in the inverted position.

Further objects, features and advantages of this invention will become apparent from the following description and drawings.

DESCRIPTION OF THE PREFERRED EMBODIMENT

Figure 2:
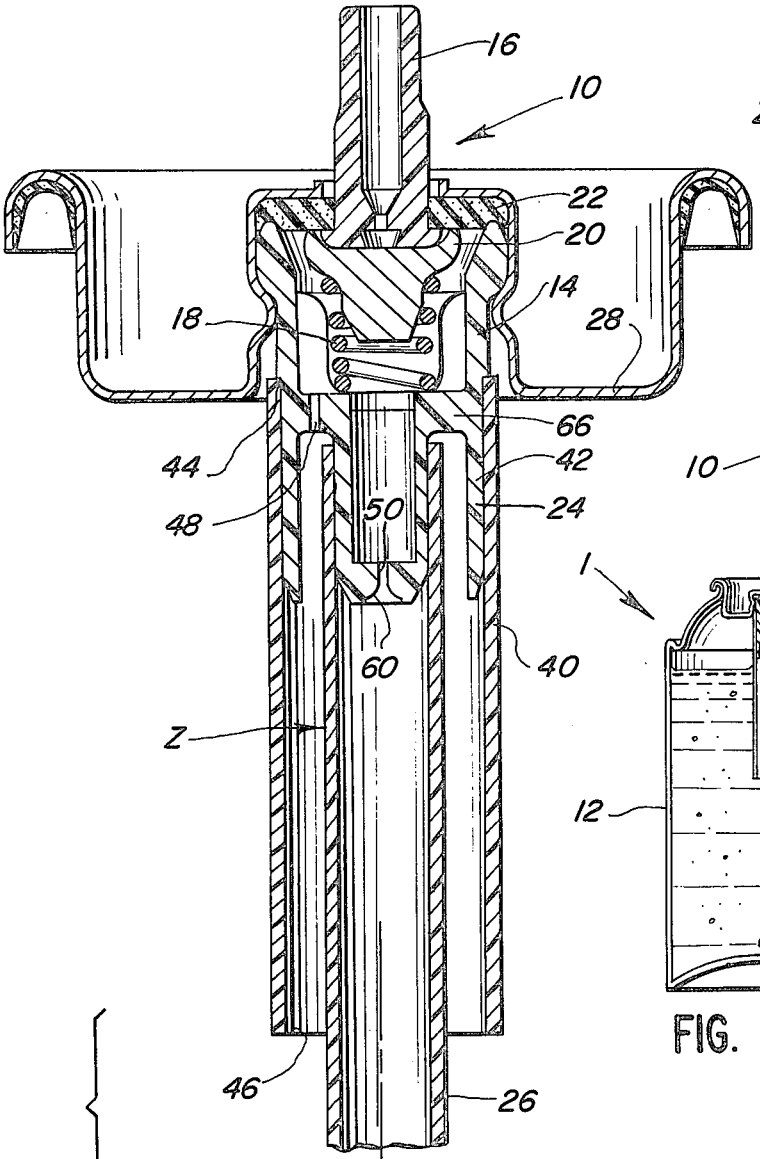
FIG. 2 is an enlarged cross-sectional view of the aerosol assembly of FIG. 1.
Figure 2:
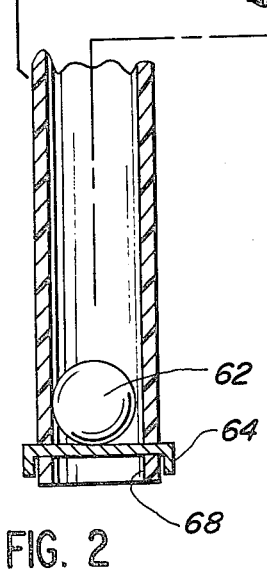

Referring now to the preferred embodiment of the present invention, a package such as an aerosol container and valve assembly 1 of this invention comprises a preassembled aerosol valve assembly 10 adapted to be secured to a container 12. The aerosol valve may be of a known, conventional type, and may comprise a plastic valve body 14, a tubular valve stem 16 and a valve closing means such as a spring 18. A conventional valve actuator, not shown, such as a conventional spray button with a dispensing orifice, may be used to actuate the valve in a known manner.

Spring 18 biases a valve seat 20 against a gasket 22, thereby to seal the interior of the body from the exterior of the container 12, except when the valve stem is operated. The valve body terminates in a tailpiece 24 adapted to mount a dip tube 26.

The valve body 14 defines a hollow interior and is crimped to a mounting cup 28 which in turn is crimped to an aerosol can or container of any desired conventional kind, such as container 12. When the assembly is to be used, the valve stem 16 via the associated valve actuator is tilted, which in turn tilts valve seat 20, placing the interior of the can, through tailpiece 24, valve body 14, and the longitudinal passageway in valve stem 16 with the atmosphere. It will be appreciated that both male and female valve constructions may be used.

Figure 3:
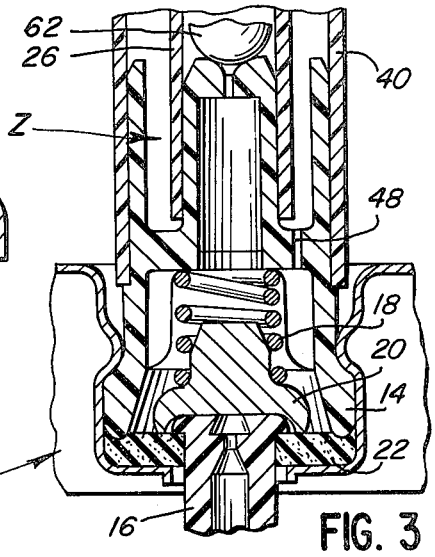
FIG. 3 illustrates the assembly of FIG. 1 in the inverted position.

The aerosol valve assembly 10 is provided with a liquid level spray control means. The spray control means includes an auxiliary tube such as a hollow tube 40 which is operatively connected and secured to the valve assembly. As seen in FIGS. 2 and 3, the valve body 14 provides a depending, integral tubular fitting 42. An annular shoulder 44 provides a stop for locating the auxiliary tube 40, thereby to control the elevation of the opening means such as opening 46 defined by the tube 40. In use the opening 46 comprises an annular opening surrounding diptube 26. In the annular zone Z between diptube 26 and tailpiece 24, on the one hand, and the fitting 42 and associated auxiliary tube 40 on the other hand, the valve body 14 defines one or more apertures 48 to provide communication between zone Z and the interior of the valve body 14. Thus the valve body interior is in continuous flow communication with the container interior via a flow path through zone Z and opening 46.

Figure 1:
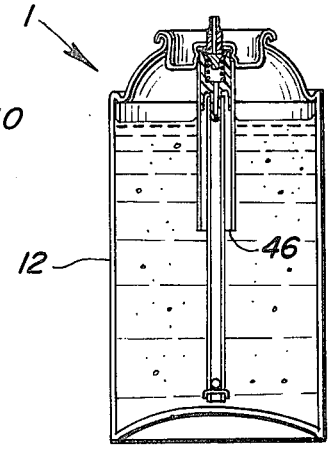
FIG. 1 is a view of an aerosol assembly of this invention showing a typical liquid level for the contents of the package as sold.

As seen in FIGS. 1 and 2, when the assembly 1 is in an upright position, and the valve assembly 10 is actuated, liquid is supplied to the valve body 14 through both the diptube (and tailpiece orifice 50) and the auxiliary tube 40 (and aperture 48). Of course, the discharge flow rate is determined by the orifices in the stem and dispensing button as is known.

As stated, the aerosol assembly 1 of this invention is also designed to operate in an inverted position, but for discharging only a controlled amount of the container contents in the liquid phase in that position. To that end, as seen by the transition from the upright position of FIG. 1 to the inverted position of FIGS. 5–7, tailpiece 24 defines a valve seat 60 adapted to cooperate with a ball valve 62. Ball valve 62 is normally in its lower position, shown in FIG. 1, remote from seat 60. It is retained in the diptube, as by a retainer 64 which may comprise a staple, rivet or the like secured suitably to the diptube. Normally, in the upright position, liquid may pass through the diptube and past ball valve 62.

Figure 4:
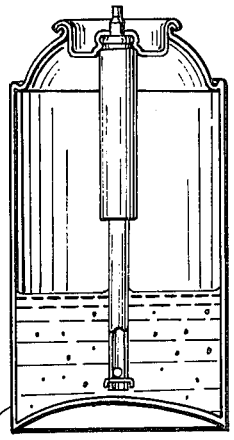
FIG. 4 shows the assembly of FIG. 1 in a partially discharged condition during its continuous discharge or fogging mode.
Figure 5:
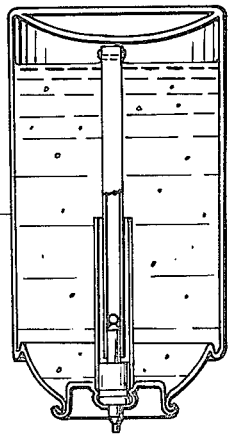
FIG. 5 is a view of the assembly of FIG. 1 in an inverted position.
Figure 6:
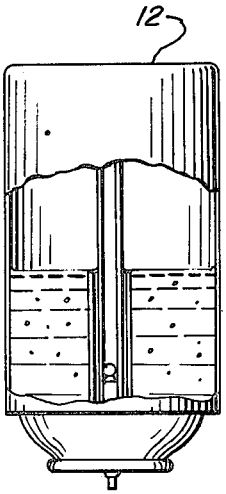
FIG. 6 is a view of the assembly of FIG. 5 in which the liquid level is at an elevation at which a user is being signalled that the continuous spray mode is then timely.
Figure 7:
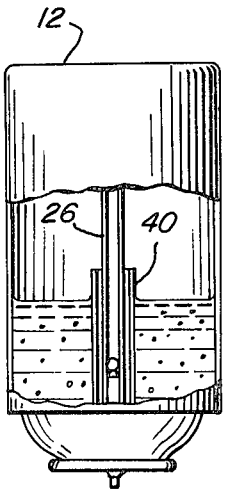
FIG. 7 is a view of the assembly of FIG. 4 in a position in which a constant signal would be provided that the continuous spray mode should have already been initiated.

When the assembly 1 is inverted, as shown in FIGS. 5 and 6, the ball valve 62 drops by gravity until it seats on the valve seat 60, thereby to prevent further flow through orifice 50. Thus, when the container is inverted and relatively full (Fig. 5), the gas phase will not enter the valve body 14 and the liquid phase will enter the valve body through aperture 48. As such, for the intended intermittant inverted use of the assembly, only the liquid phase is discharged until the preselected amount of the container contents has been discharged, i.e., until the inverted liquid level descends to the level of the opening 46 which then places the valve body in communication with the gas phase zone in the container through opening 46 (see FIG. 6). At that time the user will experience a readily perceivable signal by the change from liquid phase to gas phase discharge from the container. This signals the fact that the preselected portion of the contents of the container has been discharged so that the remainder of the contents should be discharged in the upright fogging mode At that time, the user should then discontinue inverted use of the package, and should return the container to the upright position. That will cause ball valve 62 to drop to retainer 64, opening communication between the valve body 14 and the tailpiece orifice 50 and diptube 26. The user should then complete the use of the container in the upright fogging mode, during which time the contents pass upwardly through the diptube 26 until the liquid contents are exhausted and the last of the pressurized gaseous phase is exhausted as well. Of course, the gas phase will also be dispensed at the same time because aperture 48 and zone Z are open to communication with the container interior. The proportioning of the orifice 50 and apertures 48 is preferably such that a desired mix of the gas and liquid phase is dispensed during the fogging use of the package, i.e., during use as represented by FIG. 4.

It will be apparent that the amount of the product dispensed before the user is automatically signalled that the fogging mode should be initiated will be determined by the location of the control opening 46 in the inverted position. The preferred location is such that at least about 50% of the contents will be reserved for spraying in the fogging mode. Under some circumstances it may be desirable to reserve as much as 75% or more of the contents for discharge in the fogging mode. Thus, the control opening 46 is desirably located in the mid-region or about halfway, say 40 to 60% of the distance, between the base 66 of the valve body 14 and the lower end 68 of the diptube 26. If the level of the liquid fill in the container is substantially below the base 66 of the valve body 14, then the control opening 46 should be disposed about midway between the upper liquid level of the initial fill and the lower end of the diptube. In either case, the control opening 46 should be located no higher than about 20% of the distance between the those points and no lower than about 80% of the distance between those points.

An examplary use of the present invention is for flea control and extermination. At present, in some parts of the country, flea infestation has become almost epidemic. In treating rooms and associated carpeting and cabinetry and the like, consumers purchase aerosol cans of insecticides formulated to exterminate fleas. The preferred practice is intermittantly to discharge part of the contents downwardly, as in corners and on carpets, and then to use a continuous fogging spray actuator to discharge the remainder of the contents in a closed room with the user absent from the room.

In an embodiment of the present invention for that purpose, a suitable mechanical break-up actuator may be used in the initial phase discharge. Thereafter, for the continuous fogging mode, a suitable total release actuator may be used.

A typical assembly may comprise a liquid fill of about 7½ ounces and may be about 5½ inches tall. The liquid level in the can before use may be approximately 4¾ inches. The lower end of the hollow tube is positioned at about 3½ inches below the level of the base of the valve body and about 2¾ inches below the level of the liquid phase when the container is in the upright position.

Thus, when about 25 to 30% of the liquid contents have been discharged, the very different sound of gas discharging, rather than liquid discharging, will automatically signal the user that the remainder of the contents should be discharged in the upright, fogging mode.

From the foregoing, it will be observed that numerous variations and modifications may be effected without departing from the true spirit and scope of the novel concept of the invention. It is to be understood that no limitation with respect to the specific embodiments illustrated herein is intended or should be inferred. It is, of course, intended to cover by the appended claims all such modifications as fall within the scope of the claims.

What is claimed is:

1. An aerosol container and aerosol valve assembly for automatically signalling, when used in an inverted position, that a pre-selected amount of the contents of said aerosol container has been discharged, said valve assembly comprising a valve body defining a hollow interior and a base, a hollow diptube operatively connected to said valve body interior and adapted to reach at its lower end to the bottom of said aerosol container, a moveable valve stem for placing said valve body interior in communication with the exterior of said aerosol container, and liquid level spray control means comprising a hollow tube operatively connected to said valve body and surrounding said diptube, said hollow tube defining opening means therein spaced below said valve body base, said opening means defining an open flow path from said container interior, between said diptube and said hollow tube, and to said valve body, an opening defined by said valve body and being in flow communication with said open flow path, thereby to place said valve body interior and the interior of said container in flow communication, said hollow tube extending downwardly from said valve body base, and said opening means being positioned below said base at least about 20% of the distance between said base and said diptube lower end and no more than a distance of about 80% of the distance between said base and said diptube lower end, said opening means being in open flow communication with said valve body interior both when said aerosol container and said valve assembly are in an inverted position and in an upright position.

2. An aerosol container and aerosol valve assembly in accordance with claim 1 wherein said hollow tube extends downwardly to the position defined, and wherein said opening means comprises an open lower end of said hollow tube.

3. An aerosol container and aerosol valve assembly in accordance with claim 1 wherein said control means further comprises valve means for automatically sealing said diptube from communication with said valve body interior when said aerosol container and valve assembly is in an inverted position.

4. An aerosol container and aerosol valve assembly in accordance with claim 3, wherein said valve means comprises a valve seat and a ball valve which is seated on said seat when said aerosol container and aerosol valve assembly are in said inverted position.

5. An aerosol container and aerosol valve assembly in accordance with claim 2 wherein said hollow tube open lower end is disposed in the midregion between said diptube lower end and said valve body base.

6. An aerosol valve assembly for automatically signalling, when used in an inverted position, that a preselected amount of the contents of an associated aerosol container has been discharged, comprising a valve body defining a hollow interior and a base, a hollow diptube operatively connected to said valve body interior and adapted to reach at its lower end to the bottom of an aerosol container, a moveable valve stem for placing said valve body interior in communication with the exterior of an aerosol container, and liquid level spray control means comprising a hollow tube operatively connected to said valve body and surrounding said diptube, said hollow tube defining opening means therein spaced below said valve body base, said opening means being positioned to define an open flow path from an aerosol container interior, and between said diptube and said hollow tube leading to said valve body, an opening defined by said valve body and being in flow communication with said open flow path, thereby to place said valve body interior and said opening means in flow communication, said hollow tube extending downwardly from said valve body base, and said opening means being positioned below said base at least about 20% of the distance between said base and said diptube lower end and no more than a distance of about 80% of the distance between said base and said diptube lower end, said opening means being in open flow communication with said valve body interior when said aerosol valve assembly is in each of an inverted and an upright position.

7. An aerosol valve assembly in accordance with claim 6 wherein said hollow tube extends downwardly to the position defined, and wherein said opening means comprises an open lower end of said hollow tube.

8. An aerosol valve assembly in accordance with claim 6 wherein said control means further comprises valve means for automatically sealing said diptube from communication with said valve body interior when said aerosol valve assembly is in an inverted position.

9. An aerosol valve assembly in accordance with claim 8, wherein said valve means comprises a valve seat and a ball valve which is seated on said seat when said aerosol valve assembly is in said inverted position.

10. An aerosol valve assembly in accordance with claim 7 wherein said hollow tube open lower end is disposed in the midregion between said diptube lower end and said valve body base.

* * * * *